US008007407B2

(12) United States Patent
Richter

(10) Patent No.: US 8,007,407 B2
(45) Date of Patent: Aug. 30, 2011

(54) WHEELCHAIR ACCESSIBLE TREADMILL

(76) Inventor: Mark Richter, Nashville, TN (US)

( * ) Notice: Subject to any disclaimer, the term of this patent is extended or adjusted under 35 U.S.C. 154(b) by 0 days.

(21) Appl. No.: 12/422,069

(22) Filed: Apr. 10, 2009

(65) Prior Publication Data

US 2009/0258763 A1 Oct. 15, 2009

Related U.S. Application Data

(60) Provisional application No. 61/044,042, filed on Apr. 10, 2008.

(51) Int. Cl.
*A63B 22/02* (2006.01)

(52) U.S. Cl. ..... 482/54; 482/8

(58) Field of Classification Search ..... 482/51, 482/52, 54, 148, 904, 4, 8, 60; 602/34, 36
See application file for complete search history.

(56) References Cited

U.S. PATENT DOCUMENTS

| | | | | |
|---|---|---|---|---|
| 4,307,715 | A * | 12/1981 | Fante | 602/23 |
| 5,476,429 | A | 12/1995 | Bigelow | |
| 5,626,540 | A * | 5/1997 | Hall | 482/69 |
| 5,649,883 | A * | 7/1997 | Mayes et al. | 482/54 |
| 5,667,461 | A * | 9/1997 | Hall | 482/69 |
| 6,113,519 | A * | 9/2000 | Goto | 482/54 |
| 6,135,924 | A * | 10/2000 | Gibbs et al. | 482/54 |
| 6,436,009 | B1 * | 8/2002 | Marucci | 482/54 |
| 6,689,075 | B2 | 2/2004 | West | |
| 7,004,885 | B1 * | 2/2006 | Wu et al. | 482/4 |
| 7,618,353 | B2 * | 11/2009 | Papadopoulos et al. | 482/57 |
| 2003/0203792 | A1 * | 10/2003 | Pestes | 482/60 |
| 2004/0072656 | A1 * | 4/2004 | Wang et al. | 482/54 |
| 2007/0032353 | A1 * | 2/2007 | Wilkins et al. | 482/54 |
| 2008/0058169 | A1 * | 3/2008 | Fox | 482/54 |
| 2008/0070757 | A1 * | 3/2008 | Albert | 482/54 |
| 2009/0156372 | A1 * | 6/2009 | Solomon | 482/69 |
| 2010/0222182 | A1 * | 9/2010 | Park | 482/54 |

FOREIGN PATENT DOCUMENTS

WO WO02-15819 2/2002

OTHER PUBLICATIONS

Richter, Mark, PCT/US2009/040237, International Preliminary Report on Patentability and Written Opinion.

* cited by examiner

*Primary Examiner* — Loan Thanh
*Assistant Examiner* — Tam Nguyen
(74) *Attorney, Agent, or Firm* — Wayne Edward Ramage; Baker Donelson

(57) ABSTRACT

A wheelchair-accessible treadmill with a safety system allowing wheelchair users to exercise without the risk off steering off-course, tipping over, or rolling backwards off the treadmill. The wheelchair is secured by straps or similar means to two or more linear bearings that move along the side of the treadmill on rods or in tracks. When securely fastened, these allow the wheelchair to move forward and backward on the treadmill belt. The treadmill belt may be wider than standard, the height may be lower than standard, and a ramp may be used for access. An optical sensor may be used to determine the forward and backward movement of the wheelchair user. Wheelchair specific programs may be available through the control panel.

16 Claims, 3 Drawing Sheets

WHEELCHAIR ACCESSIBLE TREADMILL

This application claims benefit of and priority to U.S. Provisional Application No. 61/044,042, filed Apr. 10, 2008, by Mark Richter, and entitled to that filing date for priority. The specification, figures and complete disclosure of U.S. Provisional Application No. 61/044,042 are incorporated herein by specific reference for all purposes.

FIELD OF INVENTION

This invention relates to a treadmill that is usable by and accessible to wheelchair users.

BACKGROUND OF THE INVENTION

Long term manual wheelchair users are living longer, fuller lives as a result of innovative medical and technological advances. While the progress has been considerable, there are still areas of significant need in this population. Wheelchair users are over twice as likely to be obese as people in the general population, due to decreased active muscle mass and physical activity. Although the key to fitness and health with wheelchair users is the same as that of the non-disabled population (i.e., diet and exercise), there is a limited availability of wheelchair accessible cardiovascular exercise equipment for this population.

Treadmills are the most popular type of exercise equipment found in gyms and fitness centers. Currently, treadmills are not wheelchair accessible. Limitations to their use by a wheelchair user include: 1) the size of the belt is too small to accommodate the size of most wheelchairs; 2) the belt is raised off the ground, creating a step the wheelchair must climb up; 3) there are significant safety risks of either veering off and hitting the side rails, tipping over backwards when the treadmill is on an incline, or rolling backwards off the rear of the treadmill; and 4) the exercise program settings are not designed around the capabilities of wheelchair users.

Accordingly, what is needed is a treadmill that is accessible to, and safely used by, wheelchair users.

SUMMARY OF INVENTION

In several embodiments, the invention comprises a wheelchair-accessible treadmill. The treadmill may be motor driven, or powered in other ways known in the art for powering treadmills. In one embodiment, the treadmill belt is wider than standard treadmills, and is designed to accommodate a wide range of manual wheelchair sizes. The height of the treadmill deck may be lowered to minimize the step height. A ramp, which may be removable, may be used to assist the wheelchair user to board independently.

In one embodiment, a safety system allows the wheelchair users to exercise without the risk of steering off course (i.e., off the side of the belt), tipping over backwards, or rolling backwards off the rear of the treadmill. The safety system comprises two or more straps (or similar means) that secure the front of the wheelchair to two linear bearings on the sides of the treadmill. In one embodiment, the linear bearings slide on two rods that run on the side of the treadmill alongside the belt. The linear bearings also may slide inside two tracks that run along the side of the treadmill. When fastened, this system allows the wheelchair to move forward and backward along the treadmill belt, while inhibiting or preventing sideways motion.

The rods or tracks may run all or a portion of the length of the belt. In one embodiment, the lengths of the rods or tracks are designed to run only a portion of the length of the belt so that the wheelchair cannot roll forward beyond the front edge of the treadmill deck, or backward off the rear edge of the treadmill deck. When the straps are tightened, the wheelchair cannot tip backwards.

In one embodiment, one or more switches or sensors can be used to cause the treadmill to stop or enter pause mode. Accordingly, for example, if the treadmill is moving too fast and the wheelchair user cannot keep pace, the wheelchair will roll back until the linear bearing reaches the end of their rods. One or more switches or sensors located at or near the back end of the rods are activated when this occurs, causing the treadmill to stop or enter "pause" mode. When pause mode is entered, the belt is stopped and the treadmill levels off, allowing the user to push up to the control panel and modify the program settings or restart the treadmill, or alternatively, get off of the treadmill.

In another embodiment, the present invention further comprises a series of exercise programs tuned to the wheelchair user. In comparison to typical settings for an ambulatory user, the wheelchair specific settings may lead to faster speeds when the treadmill is level and slower speeds when the treadmill is on an incline. In another embodiment, the maximum speeds and grades are lower for wheelchair-specific settings. In order to allow the treadmill to be used by both populations, the user can select whether to use the wheelchair settings or the ambulatory settings during the start up process.

In yet another embodiment, the invention further comprises a non-contact optical sensor on the front of the treadmill. The sensor continually monitors the distance of the user from the front of the treadmill or the sensor, and is used to estimate cadence based on the fore/aft motion of the user, based on the time elapsed between the user moving forward versus rearward on the treadmill belt. Cadence feedback may be provided to the wheelchair user on the control panel in the form of a predicted number of pushes per minute, based on each fore/aft cycle. This feedback allows users to monitor their propulsion technique, and make the changes required to minimize their cadence.

DETAILED DESCRIPTION OF EXEMPLARY EMBODIMENTS

Figure 1:
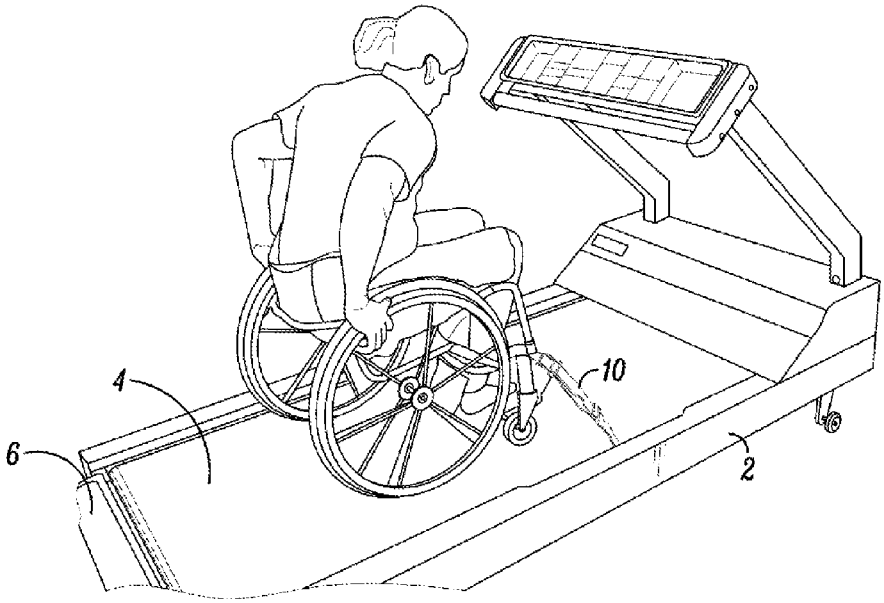
FIG. 1 shows a view of a treadmill in accordance with an embodiment of the present invention.

In one exemplary embodiment, as shown in FIG. 1, the present invention comprises a treadmill 2 that a wheelchair user can independently board and operate. The treadmill 2 may be motor driven, or powered in other ways known in the art for powering treadmills. The treadmill belt 4 may be wider than standard treadmills, and may be designed to accommodate a wide range of manual wheelchair 22 sizes. The height of the treadmill deck may be lowered to minimize the step height. A ramp 6, which may be removable, may be used to assist the wheelchair user to board independently.

Figure 2:
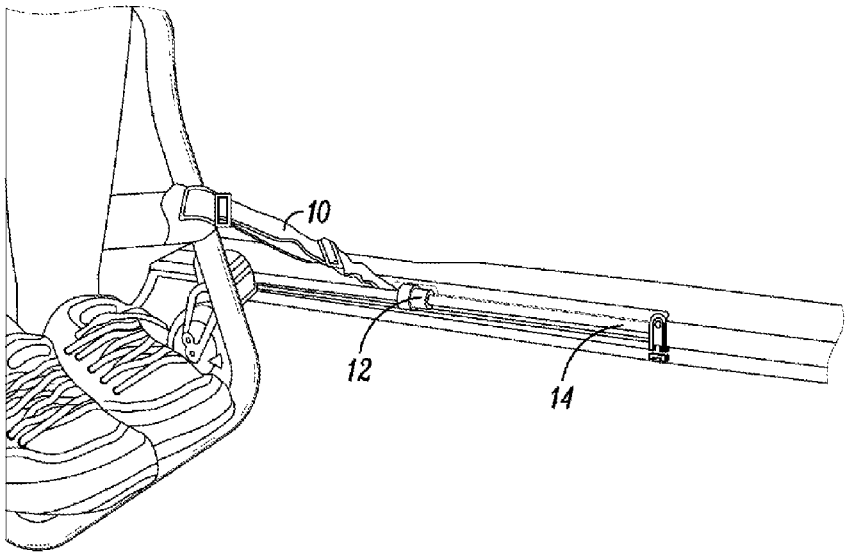
FIG. 2 shows a view of a strap in accordance with an embodiment of the present invention.
Figure 3:
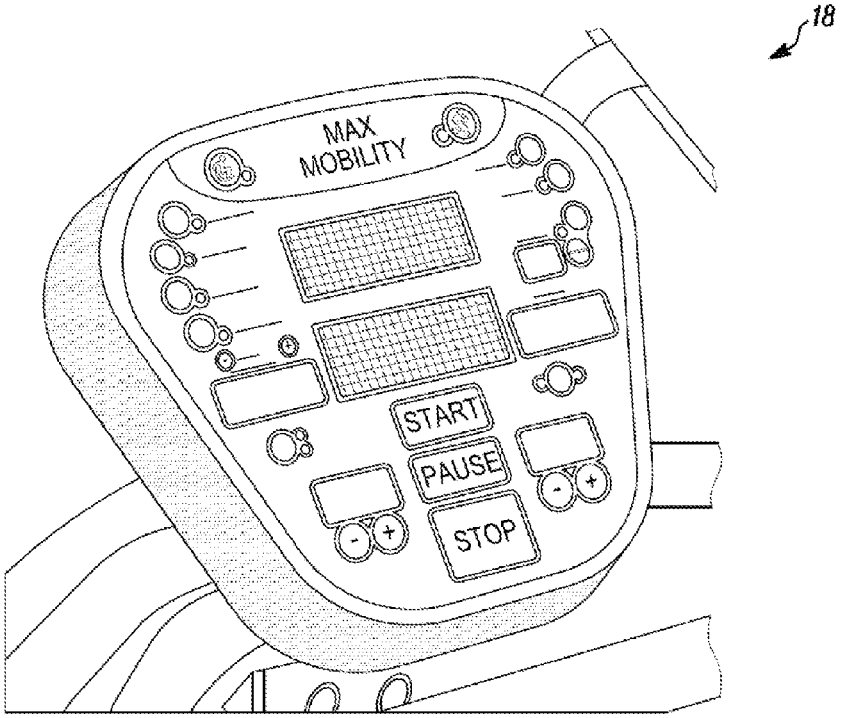
FIG. 3 shows a view of a control panel in accordance with an embodiment of the present invention.
Figure 4:
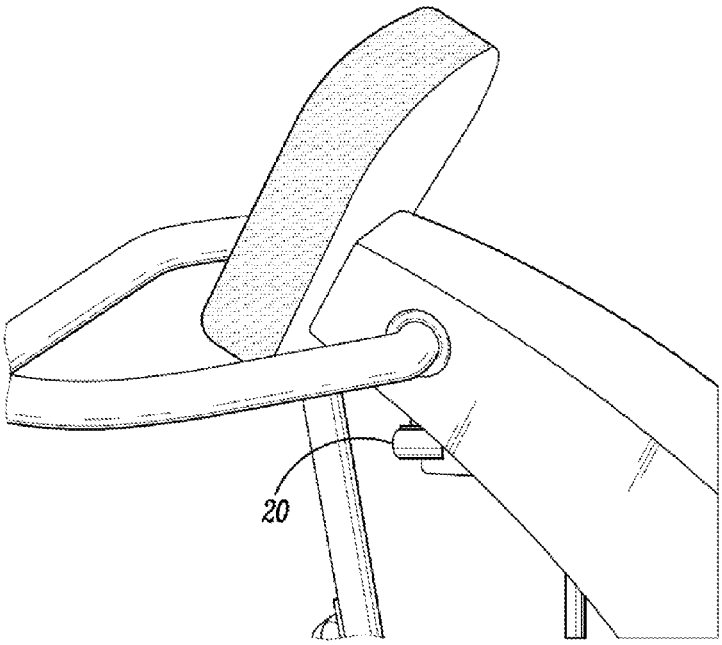
FIG. 4 shows a view of an optical sensor in accordance with an embodiment of the present invention.
Figure 5:
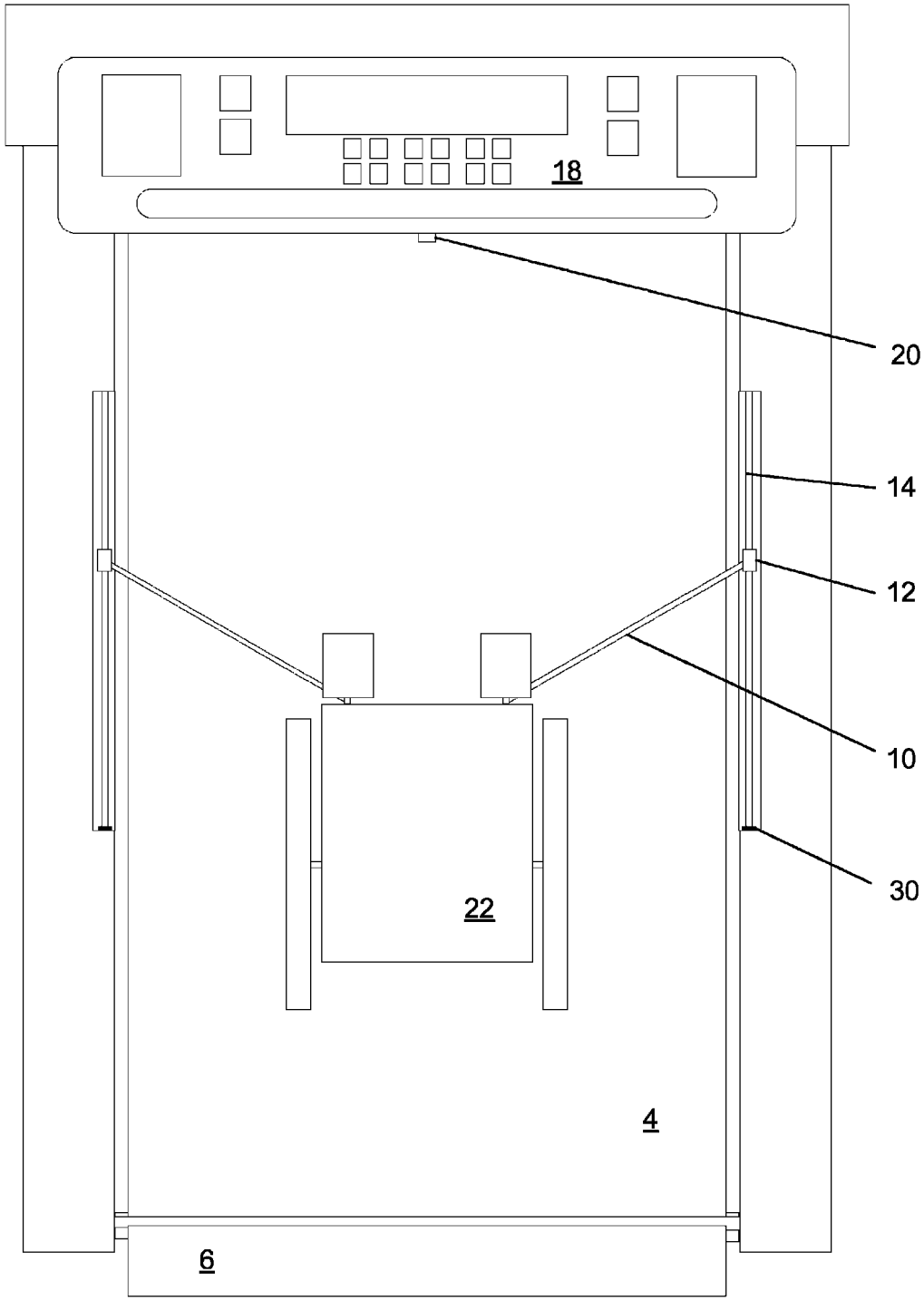
FIG. 5 shows a top view of a treadmill in accordance with an embodiment of the present invention.

In one embodiment, a safety system allows the wheelchair users to exercise without the risk of steering off course (i.e., off the side of the belt), tipping over backwards, or rolling backwards off the rear of the treadmill. As shown in FIGS. 1 and 2, the safety system comprises two or more straps 10 (or cords, ropes, cables, rods, pistons, or similar devices) that secure the front of the wheelchair to two linear bearings 12 on the sides of the treadmill. The straps may not stretch, or may be wholly or partially elastic. If elastic, the straps should not stretch so far as to allow the wheelchair to tip over, or to move off either side of the belt. In one embodiment, the linear bearings 12 slide on two rods 14 that run on the side of the treadmill alongside the belt. The linear bearings also may slide inside two tracks 16 that run along the side of the treadmill. When fastened, this system allows the wheelchair to move forward and backward along the treadmill belt, while inhibiting or preventing sideways motion.

The rods 14 or tracks 16 may run all or a portion of the length of the belt. In one embodiment, the lengths of the rods 14 or tracks 16 are designed to run only a portion of the length of the belt so that the wheelchair cannot roll forward beyond the front edge of the treadmill deck, or backward off the rear edge of the treadmill deck. When the straps are tightened, the wheelchair cannot tip backwards.

In one embodiment, if the treadmill is moving too fast and the wheelchair user cannot keep pace, the wheelchair will roll back until the linear bearing reaches the end of their rods. One or more switches or sensors 30 located at or near the back end of the rods are activated when this occurs, causing the treadmill to stop or enter "pause" mode. When pause mode is entered, the belt is stopped and the treadmill levels off, allowing the user to push up to the control panel 18 and modify the program settings or restart the treadmill, or alternatively, get off of the treadmill.

If program settings are not ideal, activation of the pause mode could occur frequently during use, which could frustrate wheelchair users and discourage them from using the treadmill. Accordingly, in one embodiment, the present invention further comprises a series of exercise programs tuned to the wheelchair user. In comparison to typical settings for an ambulatory user, the wheelchair specific settings may lead to faster speeds when the treadmill is level and slower speeds when the treadmill is on an incline. In another embodiment, the maximum speeds and grades are lower for wheelchair-specific settings. Thus, for example, while the maximum settings could be approximately 12 mph and a 15 degree grade for the ambulatory population, the maximum settings may be 5 mph and a 5 degree grade for the wheelchair user population. In order to allow the treadmill to be used by both populations, the user can select whether to use the wheelchair settings or the ambulatory settings during the start up process.

Research suggests that over half the manual wheelchair population has developed overuse injuries in upper extremities. Since pushing on a treadmill for exercise leads to increased demand on the user's arms, it is important to take preventative measures to reduce the risk of developing overuse injuries due to use of the treadmill. Reducing push cadence while propelling may reduce the risk of developing these overuse injuries. In one embodiment, the invention further comprises a non-contact optical sensor 20 on the front of the treadmill (the sensor may be placed in another location, provided it can accurately monitor the distance of the user from the sensor). The sensor continually monitors the distance of the user from the sensor (e.g., the front of the treadmill, in one embodiment), and is used to estimate cadence based on the fore/aft motion of the user, based on the time elapsed between the user moving forward versus rearward on the treadmill belt. Cadence feedback may be provided to the wheelchair user on the control panel in the form of a predicted number of pushes per minute, based on each fore/aft cycle. This feedback allows users to monitor their propulsion technique, and make the changes required to minimize their cadence.

The invention thus provides a treadmill that is usable by both wheelchair users and ambulatory users alike, and serves to protect wheelchair users from acute as well as long term risks associated with using a wheelchair on a treadmill.

Thus, it should be understood that the embodiments and examples described herein have been chosen and described in order to best illustrate the principles of the invention and its practical applications to thereby enable one of ordinary skill in the art to best utilize the invention in various embodiments and with various modifications as are suited for particular uses contemplated. Even though specific embodiments of this invention have been described, they are not to be taken as exhaustive. There are several variations that will be apparent to those skilled in the art.

I claim:

1. A wheelchair accessible treadmill, comprising:

a treadmill with a base with a movable belt on which both wheels of a wheelchair rest; and means to secure the wheelchair to two or more linear bearings, said linear bearings adapted to longitudinally slide along the sides of the treadmill in close proximity to the edges of the movable belt.

2. The treadmill of claim 1, wherein the linear bearings slide along rods affixed to the treadmill base.

3. The treadmill of claim 1, wherein the linear bearings slide within tracks in the base along the sides of the treadmill.

4. The treadmill of claim 1, wherein the securing means comprises two or more straps, each with a first and second end, said first end adapted to be affixed to the front of the wheelchair and said second end affixed to the linear bearing.

5. The treadmill of claim 4, wherein the straps are elastic in whole or in part.

6. The treadmill of claim 4, wherein the straps are removably attached to the wheelchair at the first end, or to the linear bearing at the second end, or both.

7. The treadmill of claim 1, wherein the linear bearings only slide for a portion of the length of the belt.

8. The treadmill of claim 7, further comprising one or more rear stops, said rear stops placed so as to prevent the linear bearings from sliding back to a position that would allow the wheelchair to go off the end of the belt.

9. The treadmill of claim 8, further comprising one or more switches or sensors located at one or more of the rear stops, said switches or sensors causing the treadmill to stop or pause whenever one or more of the linear bearings reaches a rear stop.

10. The treadmill of claim 1, wherein one end of the treadmill is low to the ground to allow easy mounting by the wheelchair.

11. The treadmill of claim 1, further comprising a ramp removably affixed to or placed adjacent to one end of the treadmill to allow easy mounting by the wheelchair.

12. The treadmill of claim 1, further comprising a control panel, said control panel providing an option for a user to select wheelchair user settings or ambulatory user settings.

13. The treadmill of claim 12, wherein the wheelchair user settings have lower maximum treadmill speed and incline values than the ambulatory user settings.

14. The treadmill of claim 1, further comprising an optical sensor on the treadmill, said sensor adapted to monitor the forward and rearward motion of the wheelchair or user on the treadmill belt.

15. A wheelchair accessible treadmill, comprising:

a treadmill with a movable belt on which both wheels of a wheelchair rest; and means to secure the wheelchair to two or more linear bearings, said linear bearings adapted to longitudinally slide along the sides of the treadmill at or near the same level as the movable belt.

16. A wheelchair accessible treadmill, comprising:

a treadmill with a movable belt on which both wheels of a wheelchair rest; and means to secure the wheelchair to two or more linear bearings, said linear bearings adapted to longitudinally slide along the sides of the treadmill alongside the movable belt at or below the height at which the securing means is secured to the wheelchair.

* * * * *